US005245898A

United States Patent [19]

Somal et al.

[11] Patent Number: 5,245,898

[45] Date of Patent: Sep. 21, 1993

[54] SLICING MACHINE LIFT ARRANGEMENT

[75] Inventors: Hardev S. Somal; Daniel Keehn; William C. Troy, all of LaPorte, Ind.

[73] Assignee: Berkel Incorporated, LaPorte, Ind.

[21] Appl. No.: 916,363

[22] Filed: Jul. 20, 1992

[51] Int. Cl.[5] ..... B26D 1/00; B26D 7/24

[52] U.S. Cl. ..... 83/58; 83/859; 83/701; 83/DIG. 1; 248/653; 248/677

[58] Field of Search ..... 83/859, 860, 701, DIG. 1, 83/544-546, 355, 356, 58, 62.1, 399, 400; 248/454, 676, 677, 371, 439, 188.2, 188.6, 188.8, 653; 192/129 A, 129 R, 130; 74/575, 577 R, 608

[56] References Cited

U.S. PATENT DOCUMENTS

| | | | |
|---|---|---|---|
| 220,552 | 10/1879 | Storle . | |
| 850,302 | 4/1907 | Greaser et al. . | |
| 853,437 | 5/1907 | Bradshaw . | |
| 1,235,647 | 8/1917 | Boehck . | |
| 1,473,264 | 11/1923 | Vaughan . | |
| 1,491,289 | 4/1924 | Clifford | 248/454 X |
| 1,544,903 | 9/1925 | Beatty . | |
| 2,187,533 | 1/1940 | Moreau . | |
| 2,351,172 | 6/1944 | White . | |
| 2,784,940 | 3/1957 | Poppe . | |
| 2,789,788 | 4/1957 | Wilson . | |
| 3,219,270 | 11/1965 | Martin et al. . | |
| 3,704,736 | 12/1972 | Pratley | 83/860 X |
| 3,740,067 | 6/1973 | Tertinek . | |
| 3,875,822 | 4/1975 | Erith et al. . | |
| 3,897,696 | 8/1975 | Schroder et al. | 74/608 X |
| 4,192,549 | 3/1980 | Petersen . | |
| 4,361,201 | 11/1982 | Hallstedt et al. . | |
| 4,424,912 | 1/1984 | Bieri et al. . | |
| 4,505,408 | 3/1985 | Sagol . | |
| 4,516,508 | 5/1985 | Kako et al. . | |
| 4,693,444 | 9/1987 | Williams et al. | 248/439 X |
| 4,815,569 | 3/1989 | Norman . | |
| 4,856,748 | 8/1989 | Obermeyer | 248/676 X |

FOREIGN PATENT DOCUMENTS

| | | | |
|---|---|---|---|
| 2105807 | 3/1983 | United Kingdom | 192/129 A |

OTHER PUBLICATIONS

Hobart Food Equipment 1712-R Slicer Brochure.

Standex Company General Slicers Brochure.

*Primary Examiner*—Eugenia Jones

*Attorney, Agent, or Firm*—Barnes & Thornburg

[57] ABSTRACT

A safe lift device for a slicing machine as provided which enables at least a portion of the slicing machine to be raised from the table or counter upon which it rests. Intermediate the two legs to be raised, a retention leg is pivotally attached to the slicing machine. Also connected to the slicing machine and the retention leg is a lever arm assembly. As the lever arm is raised, the retention leg descends toward the table or counter. Continued raising of the lever arm causes the retention leg to exert a downward force on the table, and thus an upward force on the slicing machine. A ratchet and pawl mechanism connected to the retention leg and the lever arm assembly allows the user to lock the lever arm while the slicing machine is in a raised position thus preventing the slicing machine from falling. A safety switch disenables the motor driving the slicing knife as soon as the machine is lifted approximately one inch or more. Once in a raised position, food particles and other debris may be cleaned from the slicing machine and the surrounding area.

8 Claims, 3 Drawing Sheets

SLICING MACHINE LIFT ARRANGEMENT

BACKGROUND AND SUMMARY OF THE INVENTION

The present invention relates generally to a new safety device for a slicing machine More particularly, the present invention relates to a lifting arrangement for use with a slicing machine Commercial slicing machines are widely utilized as a rapid and effective means of slicing meat, cheese, vegetables and other food products Such machines are currently manufactured by Berkel Incorporated, and sold as models 909 and 919. Such machines commonly include a motor driven circular slicing knife having a cutting edge about its periphery and a means for passing a predetermined thickness of the food product to be sliced over the rotating slicing knife. During this slicing operation, small particles of food and other debris generally fall through the slicing machine and onto the table or counter beneath the slicing machine. In order to maintain clean and sanitary conditions in the food processing area, it is often beneficial to remove these food particles and other debris, and thoroughly clean the equipment, even up to several times during the course of a day.

Most commercial slicing machines have a plurality of leg members which support the machine, and thus provide some clearance beneath the slicing machine However, the height of this clearance is generally maintained to a minimum in order to provide a convenient working height for the slicing machine when placed upon a table or counter. Thus, while it may be possible to perform some cleaning beneath the slicing machine without raising the unit, the extent of such cleaning is limited by both the lack of access, particularly to individuals having relatively large hands, and the lack of visibility to see the food particles and other debris present under the slicing machine.

Another method traditionally used to clean the area surrounding a slicing machine is to lift the slicing machine off of two of its legs with one hand, while cleaning away the debris and other food particles, along with cleaning the slicing machine itself, using the other hand. This technique has several inherent disadvantages. First, many conventional slicing machines are heavy, and can be difficult to lift and maintain in a lifted position with only one hand. Second, while the machine is being held in this lifted position, the slicing machine could inadvertently slide, slip or fall, thus exposing the individual holding the machine to potential injury, or causing damage to the machine itself. Third, having only one hand available to remove food particles and other debris near the slicing machine, and to clean the slicing machine itself, can be difficult, time consuming and ineffective, particularly when visibility of the area being cleaned is blocked by the slicing machine.

It may be possible to use two individuals to perform the cleaning task, one to hold the slicing machine while the other cleans away food particles and debris beneath it. However, this is undesirable since it obviously takes two individuals away from more productive pursuits in order to clean the slicing machine. Furthermore, the risk of injury to the individual cleaning underneath the machine if the slicing machine slides, slips or falls is still present, and may even be increased from such a two individual cleaning operation.

The applicants are aware of a device used to lift a portion of a slicing machine which includes a lever arm and a retention leg connected at a pivot point Turning the lever arm causes the retention leg to rotate towards the table or counter upon which the machine rests. Continued rotation of the lever arm causes the retention leg to contact the table or counter, and thus mechanically lift a portion of the slicing machine. However, this arrangement has disadvantages. There is no built-in safety mechanism to support the slicing machine if the user releases the lever arm after partial lifting of the machine. Even after the slicing machine is fully raised, the known arrangement does not guard against inadvertent or accidental disengagement of the lift device. If the user of the machine accidentally contacts the lever arm, the machine will fall. Also, the known arrangement makes no provision for ensuring that the slicing knife is not turning while the machine is in the lifted position.

Accordingly, an object of the present invention is to provide a lift arrangement for a slicing machine which is capable of readily lifting the slicing machine to an upright, lifted position.

A further object of the present invention is to provide a lift arrangement for a slicing machine which supports the slicing machine in a raised position to provide increased visibility and permit the use of both hands in cleaning away food particles and other debris from beneath the slicing machine.

Another object of the present invention is to provide a lift arrangement for a slicing machine which limits accidental or inadvertent release from the lifted position.

A still further object of the present invention is to provide a lift arrangement for a slicing machine which guards against lifting the slicing machine while the slicing knife is turning, and prevents actuation of the slicing knife while the machine is in a lifted position.

These and other objects of the present invention are attained by the provision of a lifting arrangement for a slicing machine. A retention leg is pivotally attached to one side of the slicing machine intermediate adjacent support legs. In a first position, the retention leg is positioned under the slicing machine with the leg substantially parallel to the table or counter on which the slicing machine is placed, thus allowing the slicing machine to be supported on its four support legs and the slicing machine available for conventional use. When it is desired to clean underneath the slicing machine, a pawl member is positioned adjacent a ratchet such that a lever arm is free to rotate in an upward direction enabling the retention leg to transition through downward rotation, thus leveraging the retention leg beneath the slicing machine to raise the slicing machine to a lifted upward position supported by two leg members and the retention leg. When in this upward tilted position, the pawl prevents the assembly from backward rotation A canopy substantially covers the ratchet and pawl mechanism, thus preventing food or other debris from interfering with the mechanism A mercury switch which disconnects the power to the driving motor is activated when the slicing machine is raised.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
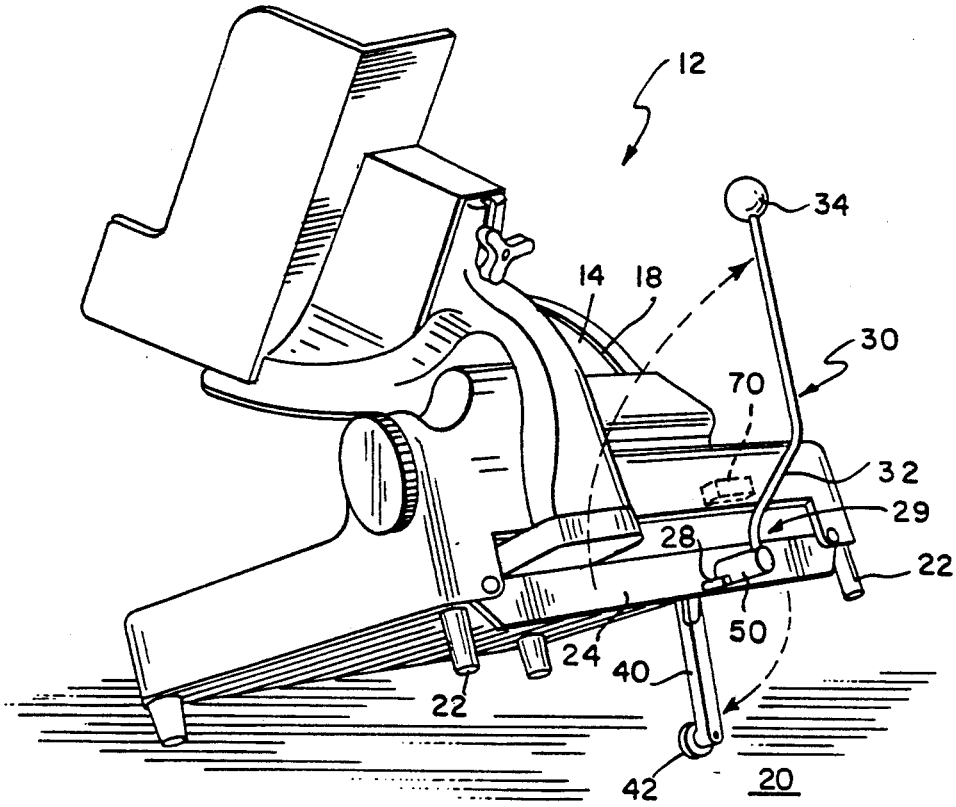
FIG. 1 is a perspective view of a first preferred embodiment of the present invention attached to a slicing machine.

Referring now to the drawings, in which like-referenced characters indicate corresponding elements throughout the several views, attention is first directed to FIG. 1, which illustrates a preferred embodiment of a lift arrangement for a slicing machine The lift arrangement is used in conjunction with slicing machine 12 which is of conventional design Slicing machine 12 generally includes circular slicing knife 14 which is rotated by means of a shaft (not shown) driven by an electric motor (not shown) Slicing machine 12 further includes an adjustable plate which supports the food product to be sliced. A slidable carriage member slides in relation to the peripheral cutting edge 18 of rotating slicing knife 14 to move the food product to be cut across the knife. The adjustable plate is generally adjustable in relation to rotating slicing knife 14 to permit the food product to be cut into slices of differing thicknesses.

As the food product is cut by rotating slicing knife 14, food particles and other debris fall underneath slicing machine 12 onto table or counter 20 upon which slicing machine 12 is supported. In order to provide support for and clearance beneath slicing machine 12, the machine preferably includes four leg members 22. It is desired that leg members 22 be long enough to provide sufficient clearance underneath the machine, while at the same time providing a comfortable working height for the operation of slicing machine 12 while it is placed on table or counter 20.

In order to maintain clean and sanitary conditions in the food processing area, it is often beneficial to remove accumulated food particles and debris that collect beneath slicing machine 12. It is also beneficial to clean slicing machine 12 from time to time. However, the height of leg members 22 is often insufficient to permit access or visibility beneath slicing machine 12 without lifting the machine off of at least two of its leg members.

In order to accomplish the lifting of slicing machine 12, the lift arrangement of the present invention consists generally of lever arm assembly 29 and retention leg 40, both pivotally attached to slicing machine 12 intermediate adjacent leg members 22 to be lifted. Lever arm assembly 29 generally includes lever arm 30 and cylinder 50. Cylinder 50 can be connected to slicing machine 12, or to a plate which is then connected to the slicing machine. In the first preferred embodiment shown, cylinder 50 is connected to front plate 24, intermediate the two front legs 22 of slicing machine 12. While in the first preferred embodiment shown, cylinder 50 is mounted to front plate 24, it will be apparent to those skilled in the relevant art that lever arm 30, retention leg 40 and cylinder 50 could be mounted directly to some other portion of slicing machine 12, or some other mounting mechanism for the lift arrangement could be readily utilized.

Lever arm 30 is preferably a generally cylindrical rod which extends substantially radially from cylinder 50. Preferably, lever arm 30 includes curve 32, such that lever arm 30 transitions substantially away from front plate 24. Curve 32 provides additional clearance between lever arm 30 and front plate 24, easing actuation of the lever arm. Lever arm 30 also preferably includes ball grip 34 at its distal end, opposite cylinder 50. Ball grip 34 allows a user to firmly grasp and actuate lever arm 30.

Figure 4:
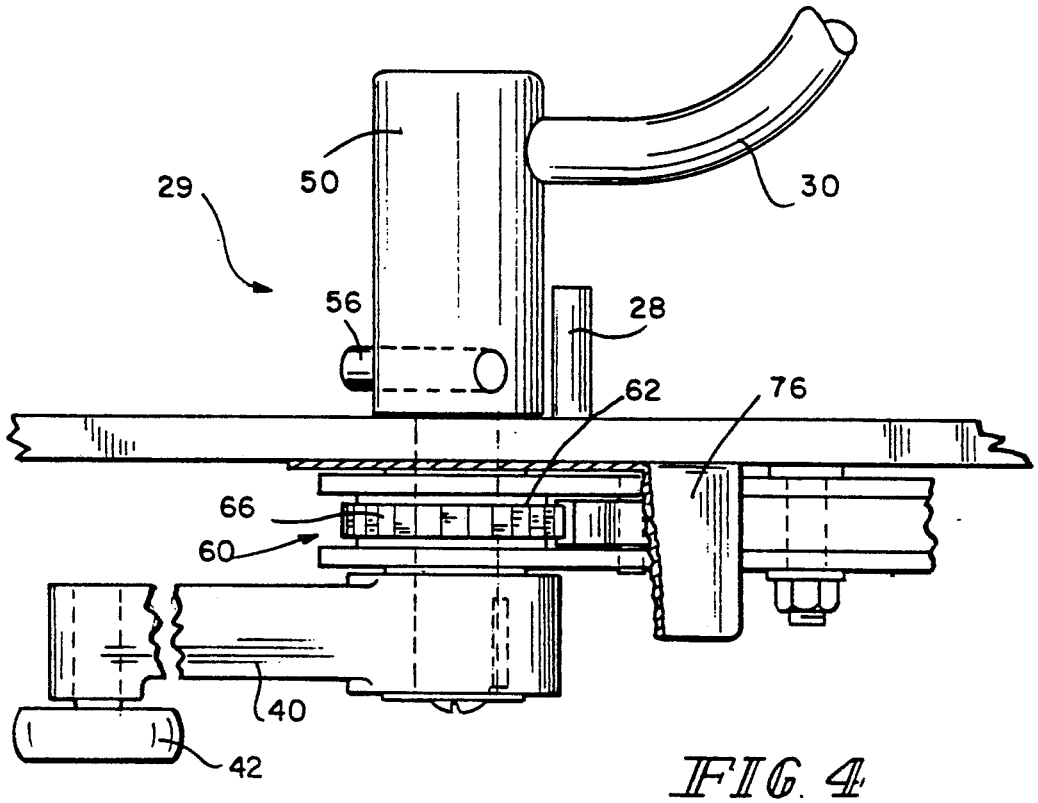
FIG. 4 is a partial plan view of a first preferred embodiment of the present invention.

Retention leg 40 is preferably a bar of generally constant proportions Retention leg 40 is connected to lever arm assembly 29 and front plate 24 on the side opposite from lever arm 30 as is shown in FIG. 4. In the preferred embodiments, retention leg 40 is connected to lever arm assembly 29 by an ordinary bolt. Retention leg 40 also extends generally radially from the longitudinal axis of cylinder 50. At its distal end, retention leg 40 includes roller 42. Roller 42 is preferably a generally circular wheel assembly which is mounted to retention leg 40. Roller 42 is preferably positioned such that its longitudinal axis is substantially parallel to the longitudinal axis of cylinder 50, and transverse to the longitudinal axis of retention leg 40. Roller 42 is preferably dimensioned such that its diameter is greater than the width of retention leg 40, such that roller 42 extends beyond retention leg 40. Roller 42 is mounted to retention leg 40 such that it may turn freely.

Figure 2:
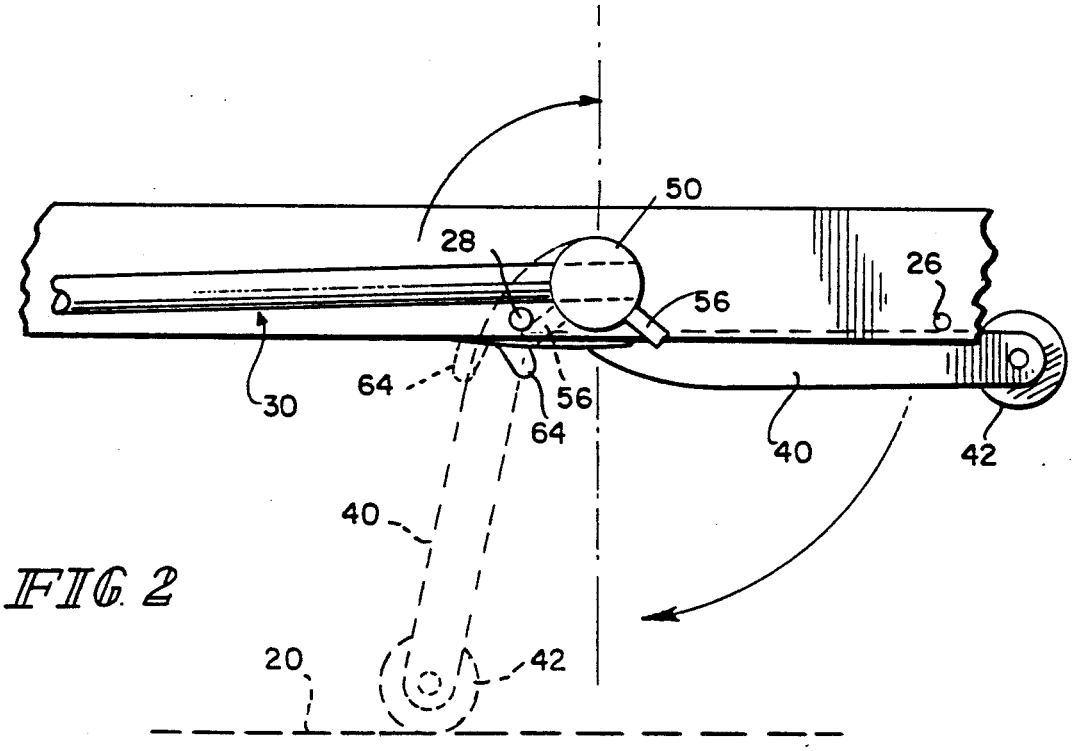
FIG. 2 shows the range of motion of the retention leg of the present invention.
Figure 3:
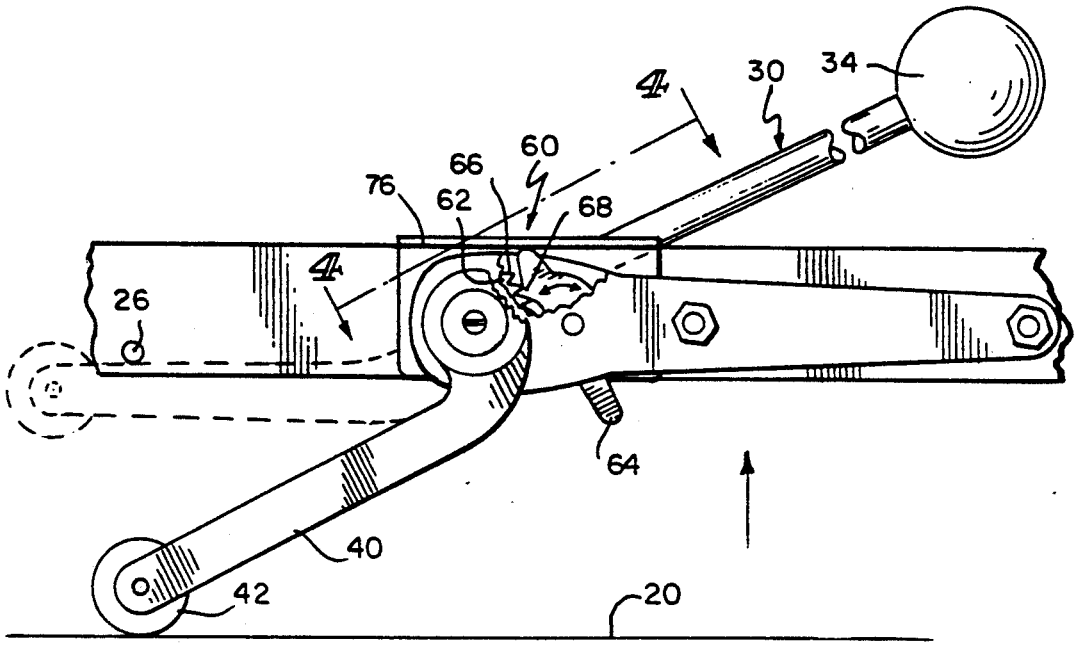
FIG. 3 is a partial cut-away view of the lift arrangement of the present invention.

In the normal, unactuated state, both lever arm 30 and retention leg 40 rest substantially parallel to table or counter 20, as is shown in FIG. 2. The longitudinal axis of both lever arm 30 and retention leg 40 are substantially co-planar, in a plane substantially parallel to the plane of table or counter 20. However, in the preferred embodiment shown, lever arm 30 and retention leg 40 extend radially from cylinder 50 in substantially opposite directions, approximately 180° apart. Thus, as lever arm 30 is raised, substantially away from table or counter 20, cylinder 50 rotates, causing retention leg 40 to descend, substantially towards table or counter 20.

In the first preferred embodiment shown, front plate 24 also preferably includes stop 26 extending generally inward from front plate 24, and generally parallel to cylinder 50. Stop 26 extends inward at least far enough to physically contact retention leg 40. Stop 26 contacts retention leg 40 when retention leg 40 is approximately parallel to table or counter 20, and prevents further motion of retention leg 40 in an upward motion, away from table or counter 20. Stop 26 thus also precludes further rotation of cylinder 50, as well as further motion of lever arm 30 in a direction substantially towards table or counter 20. In the preferred embodiment shown, stop 26 is an ordinary bolt.

The first preferred embodiment of the present invention also includes a stop mechanism which limits the rotation of lever arm 30 and retention leg 40 so that in the extreme position they are substantially upright. Near front plate 24, cylinder 50 includes peg 56. Peg 56 is preferably a relatively short member, extending substantially radially from cylinder 50. Extending outward from front plate 24 is post 28. Post 28 is preferably located near cylinder 50, and extends substantially parallel to the cylinder. When the lift arrangement is in the unactuated position, peg 56 on cylinder 50 is substantially remote from post 28. As lever arm 30 is raised, cylinder 50 rotates, drawing peg 56 towards post 28. Post 28 is positioned such that peg 56 contacts post 28 when lever arm 30 and retention leg 40 are in the desired fully lifted position. It is preferred that retention leg 40 be approximately 15° past center in the fully upright position. The contact between peg 56 and post 28 prevents further rotation of lever arm 30 and retention leg 40 in the direction of actuation.

The lift arrangement also includes ratchet and pawl mechanism 60. Ratchet and pawl mechanism 60 generally includes ratchet 62 and pawl 64. Ratchet 62 is a generally cylindrical gear, which is connected to lever arm assembly 29 between cylinder 50 and retention leg 40. In the preferred embodiment shown, ratchet 62 encircles a portion of the bolt connecting retention leg 40 to lever arm assembly 29, intermediate retention leg 40 and front plate 24. Ratchet 62 includes a plurality of teeth 66 around its periphery, as is customary in known ratchet or gear arrangements. While ratchet 62 may be constructed having most any desired number of teeth 66, the applicants' preferred embodiment of ratchet 62 has 36 teeth.

Pawl 64 is a mechanical switch positioned adjacent ratchet 62, which determines the free-wheeling or locked direction of ratchet 62. Pawl 64 includes tongue 68 thereon, which is engageable with teeth 66 on ratchet 62. Pawl 64 is pivotable such that tongue 68 may be positioned to engage teeth 66 in either direction. Teeth 66 and tongue 68 are constructed such that when tongue 68 engages teeth 66, ratchet 62 may continue to rotate, but only in one selectable direction. Pawl 64 prevents rotation of ratchet 62 in the opposite direction. Ratchet and pawl mechanism 60 is constructed such that pawl 64 is positioned so that ratchet 62 can only rotate in a direction consistent with the generally upward movement of lever arm 30, and the generally downward movement of retention leg 40. Ratchet 62 is positively locked from rotating in the opposite direction by the unique positioning of pawl 64. While ratchet and pawl mechanism 60 has been described in detail, many known ratchet and pawl arrangements would perform substantially identically as the mechanism described The applicants' preferred ratchet and pawl mechanism, as described, is commercially available as Vendor Part No. 23-25590-9900, manufactured by Lowell Corporation.

The present invention also includes a mechanism which automatically cuts off power, thus preventing the motor from rotating slicing knife 14 while slicing machine 12 is lifted. The lift arrangement includes mercury switch 70 which is preferably mounted in a substantially horizontal position, adjacent the underside of slicing machine 12, and is connected to the control circuit of the motor which drives slicing knife 14. Mercury switch 70 is positioned such that when slicing machine 12 is lifted a pre-determined distance, the motor driving slicing knife 14 is interrupted. In the preferred embodiments shown, mercury switch 70 disconnects the power to the motor when slicing machine 12 has been raised a distance of approximately 1 inch from table or counter 20. Mercury switches and similar sensing devices are well-known, and the applicants recognize that most any of these known devices would perform the function of mercury switch 70. The applicants' preferred mercury switch 70 is manufactured by Mercury Switches, Inc., and sold as Vendor Part No. TS10-13.

The preferred embodiments of the present invention also include canopy 76. Canopy 76 is a flat plate which can be attached to front plate 24 or slicing machine 12 directly above ratchet and pawl mechanism 60. Canopy 76 acts as a shield or guard to prevent food and other debris from falling from slicing machine 12 into ratchet and pawl mechanism 60.

Having described the structure of the lift arrangement of the present invention, its function and operation can be clearly understood. The lift arrangement is designed to assist in the lifting of one side of slicing machine 12. For example, the present invention is designed to raise two adjacent legs 22 of slicing machine 12 having four such legs. The lift arrangement is positioned intermediate two legs 22 desired to be lifted; in the first preferred embodiment shown, the lift arrangement is attached to front plate 24, intermediate the two front legs 22 of slicing machine 12.

To raise slicing machine 12, pawl 64 is positioned such that ratchet 62 is free to rotate only in the generally upward direction of lever arm 30, which automatically locks ratchet 62 from rotating in the opposite direction. Without properly positioning pawl 64, lever arm 30 cannot be operated at all. Once pawl 64 is positioned, the locking features of the present invention are automatically activated. A user holds ball grip 34 and raises lever arm 30 substantially away from table or counter 20. This turns cylinder 50, causing retention leg 40 to descend towards table or counter 20. This turning of cylinder 50 also causes peg 56 to draw nearer post 28. Lever arm 30 is raised until roller 42 on retention leg 40 contacts table or counter 20. Continued lifting of lever arm 30 causes roller 42 to exert a downward force on table or counter 20, and an opposite upward force is thus exerted by table or counter 20 through retention leg 40 to slicing machine 12. Thus, slicing machine 12 is raised. Once slicing machine 12 is raised approximately 1 inch from table or counter 20, mercury switch 70 disconnects the motor driving slicing knife 14. The engagement of pawl 64 with teeth 66 allows the user to release lever arm 30 at any point during the lifting of the lever arm. If the lever arm is released, pawl 64 engages teeth 66, preventing rotation of cylinder 50 in a direction opposite to the direction of rotation during actuation. Thus, if ball grip 34 is accidentally or inadvertently released during the lifting of slicing machine 12, the machine will not fall.

Slicing machine 12 is raised its greatest distance from table or counter 20 when retention leg 40 is substantially transverse to the top of the table. However, it is preferred that lever arm 30 be rotated until retention leg 40 rotates beyond the vertical position. In the preferred embodiments, retention leg 40 rotates approximately 15° past the vertical. In this position, peg 56 on cylinder 50 contacts post 28, preventing further rotation of lever arm 30 in the actuating direction. The engagement of pawl 64 with ratchet 62 prevents rotation of retention leg 40 in the opposite, or de-actuating direction. Thus, slicing machine 12 remains securely raised a pre-determined distance above table or counter 20. This allows slicing machine 12 and the immediate surrounding vicinity to be thoroughly cleaned.

It will be recognized to those skilled in the relevant art that the length of retention leg 40 can be adjusted to provide the desired extent of lift for slicing machine 12. Furthermore, lever arm 30 could be lengthened to provide greater leverage to ease the effort needed to lift slicing machine 12. In the preferred embodiments shown, retention leg 40 and roller 42 extend approximately 6 inches from the longitudinal axis of cylinder 50, and lever arm 30 and ball grip 34 extend approximately 13 inches from the longitudinal axis of cylinder 50. These dimensions were selected such that slicing machine 12 could be raised to provide adequate access beneath the machine for removal of food particles and other debris, while requiring only a reasonable degree of effort to raise lever arm 30 to its engaged position. In addition, the preferred dimensions of lever arm 30 and retention leg 40 reduce the amount of material needed for fabrication and provide the lift arrangement with relatively compact dimensions.

To lower slicing machine 12, pawl 64 is positioned such that it frees ratchet 62 in the deactuation direction and locks in the actuation direction. The user then grasps ball grip 34 and lowers lever arm 30 in the opposite direction from the direction of actuation. Slicing machine 12 is thus lowered until roller 42 no longer contacts table or counter 20. Continued lowering of lever arm 30 causes both lever arm 30 and retention leg 40 to come to rest substantially parallel to table or counter 20. In this position, retention leg 40 contacts stop 26, preventing further motion in this direction.

Figure 5:
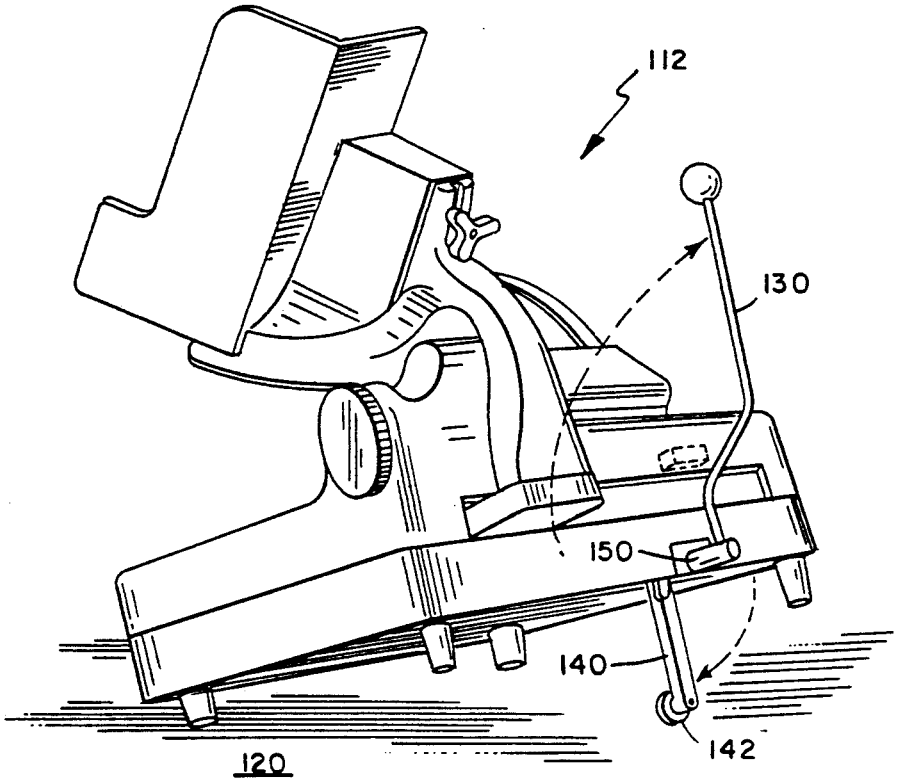
FIG. 5 is a perspective view of a second preferred embodiment of the present invention attached to a slicing machine.
Figure 6:
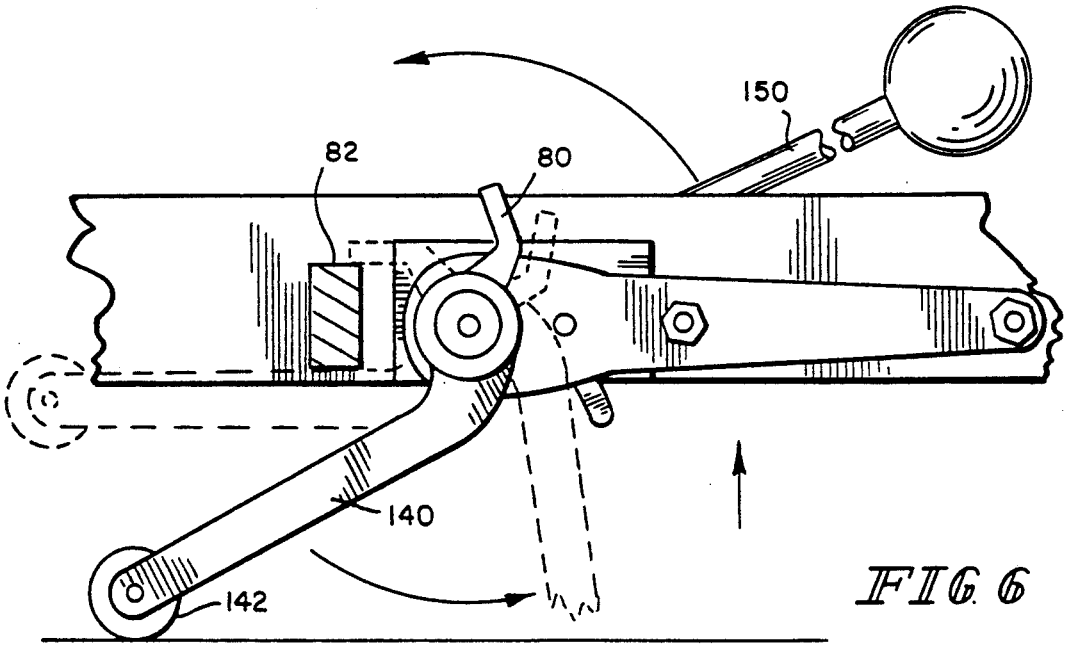
FIG. 6 is a rear view of a second preferred embodiment of the present invention.

A second preferred embodiment of the present invention is shown in FIG. 5 and FIG. 6. In this embodiment, the lift arrangement is not connected to front plate 24, but instead is attached directly to slicing machine 112. In this embodiment, retention leg 140 includes hook 80. Hook 80 extends generally radially from the longitudinal axis of cylinder 150, from the end of retention leg 140 opposite roller 142. When the lift arrangement is connected directly to slicing machine 112, hook 80 acts as a stop in the actuating direction and retention leg 140 in the deactuating direction of lever arm 130.

When the lift arrangement including hook 80 is attached directly to slicing machine 112, hook 80 combines with cross bar 82 located on the underside of the slicing machine to act as a stop. As slicing machine 112 is raised, retention leg 140 rotates, drawing hook 80 near cross bar 82. When retention leg 140 is in its most preferred, fully upright position, approximately 15° past the vertical, hook 80 contacts cross bar 82. Thus, lever arm 130 and retention leg 140 are prevented from further rotation. In the deactuation direction, as retention leg 140 leaves contact with table or counter 120, retention leg 140 draws near cross bar 82. When retention leg 140 and lever arm 130 are substantially coplanar with table or counter 120, retention leg 140 contacts the underside of cross bar 82. This prevents further rotation of retention leg 140 and lever arm 130. As hook 80 and retention leg 140 and the cross bar 82 act as stop mechanisms in both the actuating and deactuating directions, stop 26, post 28 and peg 56 are not needed in the second preferred embodiment.

From the preceding description of the preferred embodiments, it is evident that the objects of the invention are attained. Although this invention has been described and illustrated in detail, it is to be clearly understood that the same is by way of illustration and example only and is not to be taken by way of limitation. For example, various means of mounting or retrofitting the lift arrangement onto existing slicing machines could readily be used. Accordingly, the spirit and scope of this invention are to be limited only by the terms of the appended claims.

What is claimed is:

1. A device for raising at least a portion of a slicing machine from a lowered position to a raised position, said slicing machine having a motor for rotatably driving a slicing knife, comprising:

a lever arm assembly pivotally attached to said slicing machine;

a retention leg pivotally connected to said lever arm assembly for supporting at least a portion of said slicing machine;

a ratchet and pawl mechanism connected to said lever arm assembly for selectively allowing substantially one-directional motion of said lever arm assembly and said retention leg; and wherein said lever arm assembly includes a lever arm and a cylinder such that said lever arm is attached adjacent one longitudinal end of said cylinder, said retention leg being pivotally connected to said cylinder such that rotation of said lever arm causes rotation of said retention leg, and wherein said ratchet and pawl mechanism is positioned substantially intermediate said lever arm and said retention leg.

2. The device according to claim 1 further including a mechanism for preventing said one-directional motion of said lever arm assembly and said retention leg when said slicing machine is in said raised position.

3. The device according to claim 1 further including means for limiting motion of said retention leg in a direction substantially opposite said one-directional motion.

4. The device according to claim 1 further including disconnecting means for rendering said motor of said slicing machine inoperable when said slicing machine is in said raised position.

5. The device according to claim 4 wherein said disconnecting means includes a mercury switch.

6. The device according to claim 1 further including a canopy which covers said ratchet and pawl mechanism and shields said mechanism from debris.

7. A device for raising at least a portion of a slicing machine from a lowered position to a raised position, said slicing machine having a motor for rotatably driving a slicing knife, comprising:

a lever arm assembly pivotally attached to said slicing machine;

a retention leg pivotally connected to said lever arm assembly for supporting at least a portion of said slicing machine;

a ratchet and pawl mechanism connected to said lever arm assembly for selectably allowing substantially one-directional motion of said lever arm assembly and said retention leg;

a mechanism for preventing said one-directional motion of said lever arm assembly and said retention leg when said slicing machine is in said raised position; and wherein said mechanism includes a peg connected to said lever arm assembly and a post connected to said slicing machine wherein said peg contacts said post, preventing further rotation of said lever arm assembly and said retention leg.

8. A device for raising at least a portion of a slicing machine from a lowered position to a raised position, said slicing machine having a motor for rotatably driving a slicing knife, comprising:

a lever arm assembly pivotally attached to said slicing machine;

a retention leg pivotally connected to said lever arm assembly for supporting at least a portion of said slicing machine;

a ratchet and pawl mechanism connected to said lever arm assembly for selectably allowing substantially one-directional motion of said lever arm assembly and said retention leg; and means for limiting motion of said retention leg in a direction substantially opposite said one-directional motion, wherein said means includes a stop connected to said slicing machine which contacts said retention leg at a pre-determined position and which prevents further motion of said retention leg substantially opposite said one-directional motion.

* * * * *